US007357602B2

(12) United States Patent
Ferraiolo

(10) Patent No.: US 7,357,602 B2
(45) Date of Patent: Apr. 15, 2008

(54) REINFORCING DEVICE AND A BIFACIAL REINFORCING UNIT FOR EARTHWORKS AND A METHOD FOR THE PRODUCTION OF A REINFORCED EARTHWORK

(75) Inventor: Francesco Ferraiolo, Ca' de' Fabbri (IT)

(73) Assignee: Officine Maccaferri S.p.A., Bologna (IT)

( * ) Notice: Subject to any disclaimer, the term of this patent is extended or adjusted under 35 U.S.C. 154(b) by 0 days.

(21) Appl. No.: 10/569,750

(22) PCT Filed: Sep. 14, 2004

(86) PCT No.: PCT/IB2004/002961

§ 371 (c)(1),
(2), (4) Date: Feb. 24, 2006

(87) PCT Pub. No.: WO2005/026451

PCT Pub. Date: Mar. 24, 2005

(65) Prior Publication Data

US 2006/0291962 A1 Dec. 28, 2006

(30) Foreign Application Priority Data

Sep. 16, 2003 (IT) ..... BO2003A0538

(51) Int. Cl.
*E02D 29/02* (2006.01)

(52) U.S. Cl. ..... 405/273; 405/264; 405/19; 405/302.7

(58) Field of Classification Search ..... 405/273, 405/284, 19, 302.6, 302.7
See application file for complete search history.

(56) References Cited

U.S. PATENT DOCUMENTS 5,161,917 A * 11/1992 Papetti ..... 405/284
5,472,297 A * 12/1995 Heselden ..... 405/286
5,836,129 A * 11/1998 Jaecklin ..... 52/612

(Continued)

FOREIGN PATENT DOCUMENTS

EP 0 202 552 11/1986

(Continued)

OTHER PUBLICATIONS

International Search Report dated Jan. 17, 2005 (3 pages).

(Continued)

*Primary Examiner*—John Kreck
(74) *Attorney, Agent, or Firm*—Flynn, Thiel, Boutell & Tanis, P.C.

(57) ABSTRACT

A reinforcing device for earthworks comprises at least one reinforcing base element (3) from which extend a front wall (9) and a containment wall (15) which are spaced from each other to delimit, in an operative configuration in which they are erected with respect to the reinforcing base element (3), a facing region which is to be filled with filling material, such as stones or the like. The device also comprises bracket means (23) which can be coupled, in use, to the front wall (9) and to the containment wall (15). It is also possible to produce a second front wall which extends from the reinforcing base element (3) on the side opposite the first. A method for the production of a reinforced earthwork provides for laying on the ground a device of the type indicated.

23 Claims, 3 Drawing Sheets

U.S. PATENT DOCUMENTS

2003/0145526 A1* 8/2003 Rothfuss ..... 52/5

FOREIGN PATENT DOCUMENTS

| | | | |
|---|---|---|---|
| JP | 11-217812 | | 8/1999 |
| JP | 2002-61147 | | 2/2002 |
| JP | 2002-302955 | | 10/2002 |
| JP | 2002302955 | A * | 10/2002 |
| WO | WO 00/22242 | | 4/2000 |

OTHER PUBLICATIONS

Military Toxics in Hot Water, Civil Engineering, vol. 62, No. 9—p. 30 (Sep. 1992) 1 page.

* cited by examiner

REINFORCING DEVICE AND A BIFACIAL REINFORCING UNIT FOR EARTHWORKS AND A METHOD FOR THE PRODUCTION OF A REINFORCED EARTHWORK

FIELD OF THE INVENTION

The present invention relates to the field of reinforced earthworks.

BACKGROUND OF THE INVENTION

The invention was developed with particular regard to a reinforcing device for earthworks, comprising at least one reinforcing base element from which a front wall extends, a containment wall extending from the reinforcing base element at a distance from the front wall in order to delimit at the rear, in an operative configuration in which the front wall and the containment wall are erected with respect to the reinforcing base element, a facing region which is to be filled with filling material, such as stones or the like.

In addition, the present invention was developed also with reference to a bifacial reinforcing unit for earthworks and to a method for the production of a reinforced earthwork having a facing composed of stones or the like.

It is known in the field to produce parallelepipedal wire netting gabions filled with stones and superposed on one another to form a soil-supporting structure in which the filling stones define a visible surface or facing.

One of the problems of the prior art is the high cost of installing gabions, which is caused above all by two factors. The first factor is the difficulty of obtaining stones of a suitable size, which often makes it necessary to transport them to the site concerned from long distances. The stones have to be of a size larger than the dimensions of the meshes of the netting used for the gabions in order to prevent them from falling out and therefore causing the facing to be emptied. The second cost factor is associated with the filling of the gabions with the stones, which has to be carried out manually in order to obtain an aesthetically acceptable visible face with a uniform distribution of the stones.

Also known are bifacial reinforcing units composed of a gabion which is assembled beforehand and superposed on a reinforcing base element in a manner suitable for guaranteeing the essential structural continuity. This leads to higher costs owing to the doubling of material in the bottom region of the gabion.

The object of the present invention is to solve the problems of the prior art and in particular to provide a reinforcing device and a bifacial reinforcing unit for earthworks and a method for producing earthworks which permit rapid and economical installation with minimum manual intervention, at the same time ensuring the production of aesthetic facings for the earthworks. A further object is to provide reinforcing devices and bifacial reinforcing units which are economical to produce, and to obtain a high degree of reliability and strength over time for the earthworks produced by means of the present invention.

In order to achieve the objects indicated above, the present invention relates to a reinforcing device for earthworks of the type indicated in the preamble of the present description, which comprises bracket means which can be coupled, in use, to the front wall and to the containment wall in order to maintain them in the operative configuration without constituting a substantial obstacle to the filling material of the facing region.

The advantage of such a device is the ability to fill the facing region between the front wall and the containment wall using mechanical means, for example, earth-moving machines, such as mechanical shovels. The material poured into the facing region by a shovel flows freely to occupy uniformly all of the available volume, not encountering obstacles on the part of the bracket means and thus accelerating the time taken to install the reinforcing device.

The bracket means may comprise one or more bracket members located in the facing region, each coupled, in use, to the front wall and to the containment wall. Preferably, the bracket members comprise quadrangular brackets with two opposing sides coupled to the front wall and to the containment wall, respectively, and one of the other sides located near the reinforcing base element. This feature affords the advantage of providing maximum stability and rigidity for the front wall and the containment wall during the filling operation, thus preventing them from being deformed by the pressure of the filling material.

The bracket members can therefore be produced using a metal rod, a metal section bar or the like. In that case, the bracket means are very economical and are easy to produce, which is why it is also possible to use a very large number of them, thus improving the rigidity of the reinforcing device.

According to a particularly advantageous embodiment of the invention, the reinforcing base element and the front wall comprise a first and a second netting structure, respectively, the meshes of the second netting structure being more closely packed than the meshes of the first netting structure.

It is therefore possible to reduce the dimensions of the filling materials, of the stones or the like, introduced into the facing region, thus making them easier to obtain and economical. The stones of a smaller size than those traditionally used for the manual filling of known gabions also facilitate the introduction thereof using the mechanical means and the uniform distribution thereof in the facing region, thus promoting the aesthetics thereof.

Preferably, the second netting structure of the front wall comprises a first wire netting having hexagonal meshes and a second wire netting having meshes which differ from those of the first wire netting. The second wire netting and the first wire netting are coupled to each other to give, as the overall result of the coupling thereof, the second netting structure having meshes that are more closely packed than the meshes of the first netting structure of the reinforcing base element.

Preferably, although this does not constitute a limitation, the second wire netting is a netting having square meshes, for example of the electrically welded type.

The first wire netting of the front wall and the netting structure of the reinforcing base element may advantageously be folded portions of a single wire netting.

The containment wall of the present invention may advantageously be covered with a geotextile material in order to prevent any fine materials in contact with the containment wall outside the facing region from penetrating into the spaces between the filling stones of the facing.

The objects indicated above are also achieved by a bifacial reinforcing unit for earthworks which comprises a reinforcing device of the type indicated above with the addition of a second front wall which extends from the reinforcing base element on a side opposite the first front wall of the reinforcing device.

The main advantage deriving from the use of such a reinforcing unit to produce works having a central core of reinforced earth and two opposing lateral facings is the speed and economy of installation, to which is added the economical nature of the production of the unit which is due to the saving of material, compared with known units, in the production of the reinforcing base element.

A preferred method for achieving the objects indicated and producing a reinforced earthwork having a facing of stones or the like comprises the stages of laying down the reinforcing base element of a reinforcing device according to the present invention, erecting the front wall and the containment wall, holding them erect and spaced in the operative condition using the bracket means, filling the facing region delimited by the front wall and the containment wall with a first filling material, such as stones or the like, having dimensions substantially larger than the dimensions of the meshes of the front wall in order to form a portion of stone facing, filling and levelling with a second, different, filling material, such as earth, sand, crushed stone or the like and their combinations, the region affected by the reinforcing base element, which region is outside the facing region, to a height substantially equal to the height of the front wall and the containment wall, and repeating the previous stages, superposing on one another in succession a predetermined number of reinforcing devices until the desired height of the reinforced earthwork is reached.

Preferably, the filling of the facing region is carried out using the mechanical means already mentioned in order to benefit from the reduced installation times which result therefrom, and therefore to benefit from the lower production costs.

If a bifacial reinforcing unit of the type described above is used, the method also comprises, for each repetition, the formation of a second portion of a second facing at the location of the second front wall, which preferably permits subsequent re-growth of vegetation on the second facing. In that case, it is particularly advantageous from the aesthetic and practical point of view to incline each second front wall of each reinforcing unit with respect to the reinforcing base element by a predetermined angle, and to produce the reinforcing base element of each subsequently superposed reinforcing unit with smaller dimensions than that of the reinforcing unit underneath in order to produce the second facing which is inclined overall.

BRIEF DESCRIPTION OF THE DRAWINGS

Further features and advantages will become clear from the following detailed description of the preferred embodiments which is given purely by way of non-limiting example with reference to the appended drawings, in which.

DETAILED DESCRIPTION

Figure 1:
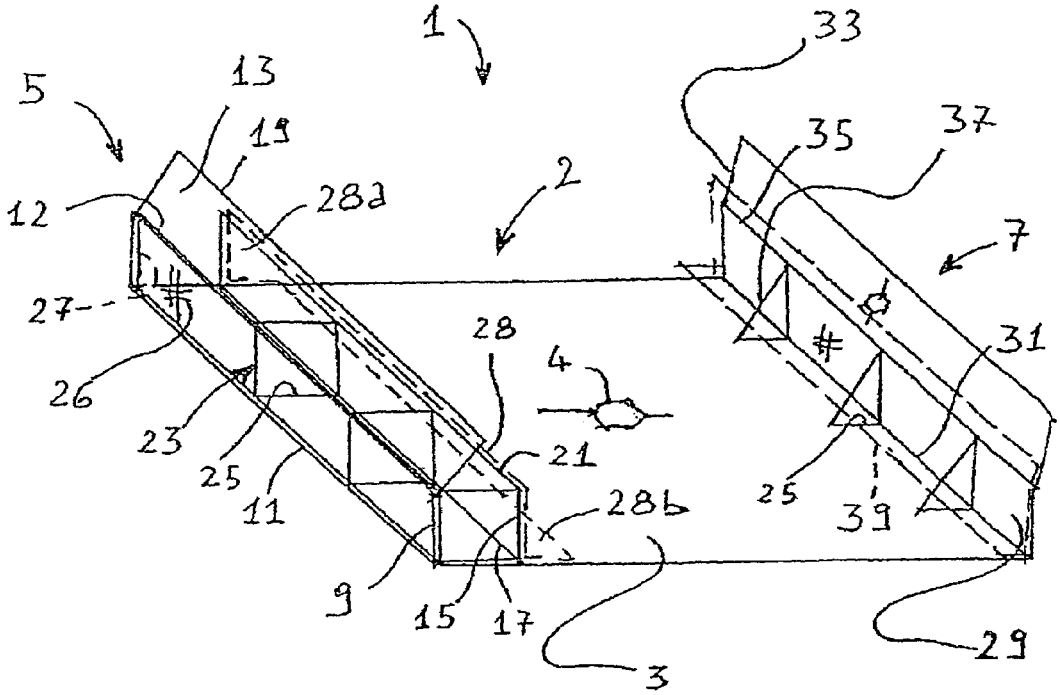
FIG. 1 is a perspective diagrammatic view of a bifacial reinforcing unit for earthworms according to the present invention.
Figure 2:
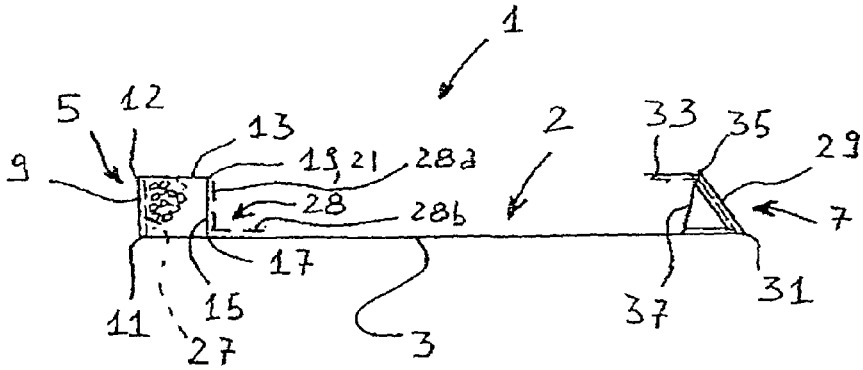
FIG. 2 is a side view of the bifacial reinforcing unit of FIG. 1, in a finished configuration.

With reference to FIGS. 1 and 2, a bifacial reinforcing unit 1 for producing reinforced earthworks comprises a netting 2 which is preferably, although this does constitute a limitation, made of metal with double-twist meshes 4 and which comprises a substantially flat central portion or reinforcement base 3. At its ends, the base portion 3 has a box-shaped structure 5, in the form of a wire netting gabion, and a "C"-shaped structure 7, respectively, which extend over the entire length of the respective ends of the central portion 3 on which they are formed.

The box-shaped structure 5 comprises a front wall 9 which is substantially at right-angles to the central portion 3 to which it is connected along an edge 11. Preferably, the front wall 9 is a first portion of the netting 2 folded along the edge 11. Extending from the front wall 9 is then a covering wall 13 which is preferably a further portion of the netting 2, folded on the folding line 12, parallel with the edge 11. The covering wall 13 is movable with respect to the front wall 9 from a raised position, indicated in FIG. 1, to a lowered position shown in FIG. 2.

One edge 17 of a containment wall 15 is connected to the central portion 3 in parallel with the edge 11, in a position which is set back relative to that edge. The containment wall 15 is preferably movable between a position lying on the central portion 3 to a position substantially at right-angles thereto. The free edges 19 and 21 of the covering wall 13 and of the containment wall 15 can be joined to form a closed chamber which has a substantially quadrangular cross-section and which is delimited by the walls 9, 13 and 15 and by part of the central portion 3, as shown in FIG. 2.

In their erect position, the front wall 9 and the containment wall 15 are supported by bracket means, such as, for example, rectangular brackets 23, which are produced, for example, using sectional members 23, such as steel rods, bent in accordance with a substantially closed and quadrangular line. The brackets 23 preferably also have a side lying on the central portion 3 and are disposed transversely to the front wall 9 and the containment wall 15 in a position such as to subdivide the volume of the box-shaped structure into at least two communicating regions.

The front wall 9 may comprise, in addition to the netting 2, or as an alternative thereto, a different netting structure or panel 27, for example electrically welded or double-twist netting, with meshes 26 different from those of the netting 2, for example, because they are smaller or have a different shape.

When the front wall 9 comprises the double netting structure, the panel 27 is preferably, although this does not constitute a limitation, positioned on the face of the front wall 9 facing the inside of the box-shaped structure 5 and is arranged in such a manner that the front wall 9 has, overall, smaller meshes than those of the netting 2. The panel 27 and the netting 2 of the front wall 9 are preferably superposed on each other with the respective meshes offset relative to each other.

The box-shaped structure 5 may also comprise a further covering element 28, with a first portion **28*a* which covers one face of the containment wall 15 and, preferably, a second portion 28*b* lying on the central portion 3. Preferably, the covering element 28 comprises a sheet of material suitable for holding back fine materials, such as, for example, a sheet of geotextile material or of electrically welded or double-twist wire netting having meshes that are finer than those of the netting 2. In addition, the covering element 28 may cover the one or the other face of the containment wall 15**.

At the other end of the central portion 3, the "C"-shaped structure 7 comprises an inclined front wall 29 connected to the central portion 3 along an edge 31 thereof. The inclined wall 29 is preferably a second lateral portion of the netting 2 folded along the edge 31.

Extending from the upper edge 35 of the inclined wall 29 is then an upper flap 33 which is preferably a further folded portion of the netting 2 and which can pass from a raised position shown in FIG. 1 to the position shown in FIG. 2 in which it forms the upper side of the "C"-shaped structure 7.

The front wall 9 may also have meshes with reduced dimensions compared with those of the central portion 3 in a manner analogous to that described above with reference to the front wall 9.

Brackets 37, for example made from a bent steel rod, support the front wall 29 in its inclined position.

The inside of the "C"-shaped structure 7 may be covered with a sheet of geotextile material 39 which contributes to the production of an inclined facing on which vegetation can grow again.

Figure 3:
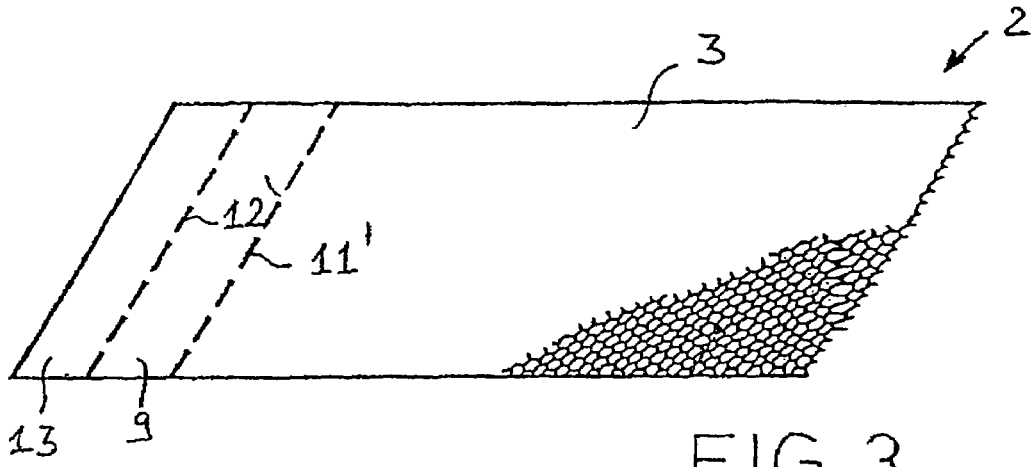
FIGS. 3 to 5 show the stages of production of a reinforcing device for earthworks according to a different embodiment of the present invention.
Figure 4:
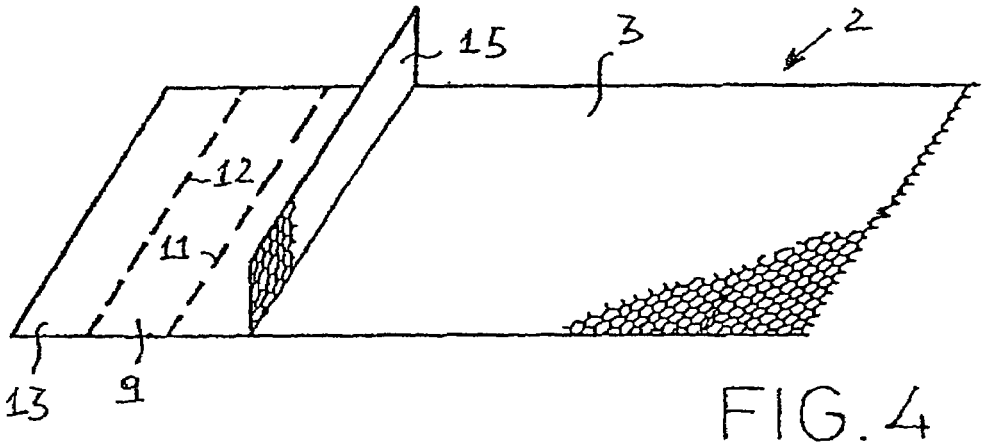
Figure 5:
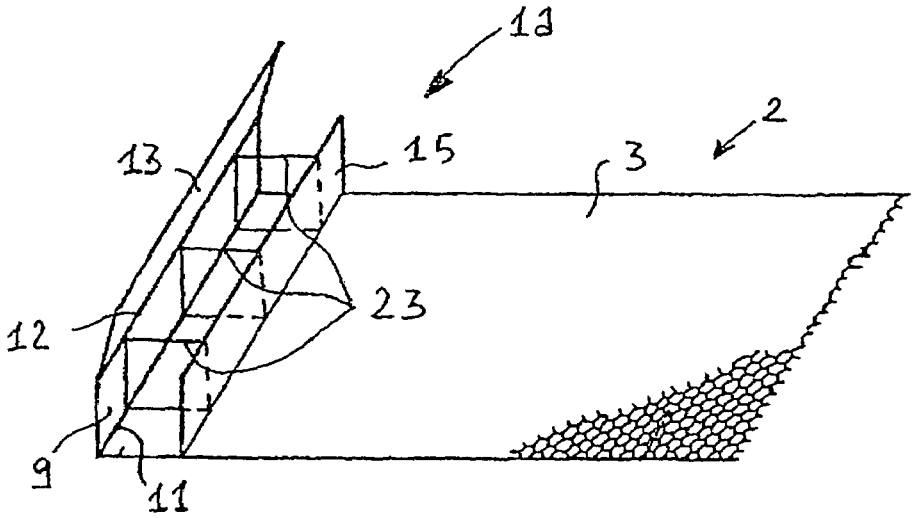

FIGS. 3 to 5 illustrate the stages of production of a re-inforcing device according to the invention in a version which is simplified or without an inclined facing compared with the bifacial example described above. A netting 2 is folded at one of its ends along the marker lines 11's and 12's to form the front wall 9 and the covering wall 13 of the box-shaped structure 5. The containment wall 15 is then joined to the central portion 3 of the netting 2 in a known manner. The front wall 9 and the containment wall 15 are erected and joined to the brackets 23 while the covering wall 13 is left in a position not joined to the containment wall 15. The brackets 23 can be joined to the reinforcing device la directly at the construction site at the time of installation or they may be provided in a form coupled to one of the walls of the box-shaped structure 5 and pivotable from a position lying on that wall into the operative position of FIG. 5. The lying-down position is favourable to the transport of the reinforcing device l*a* in the folded condition.

Figure 6:
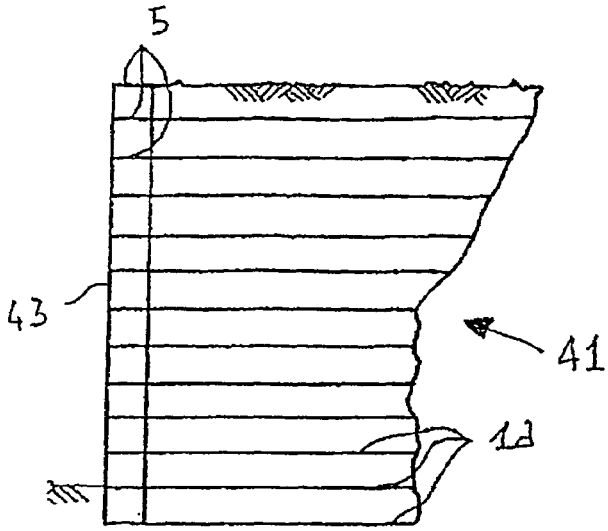
FIGS. 6, 7 and 8 are side views of one end of reinforced earthworks produced by means of reinforcing devices of FIGS. 3 to 5.
Figure 7:
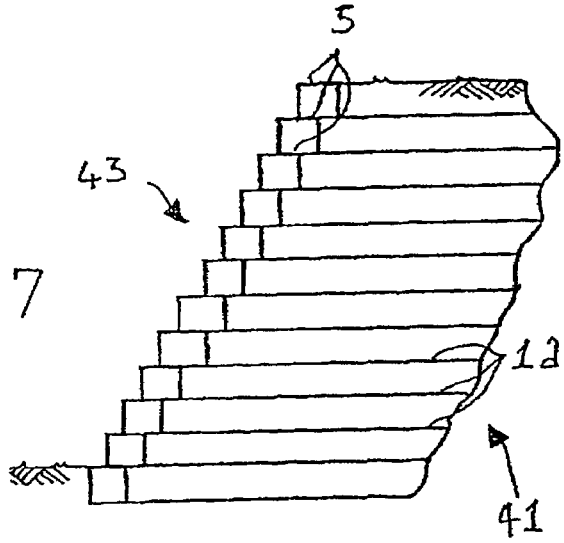
Figure 9:
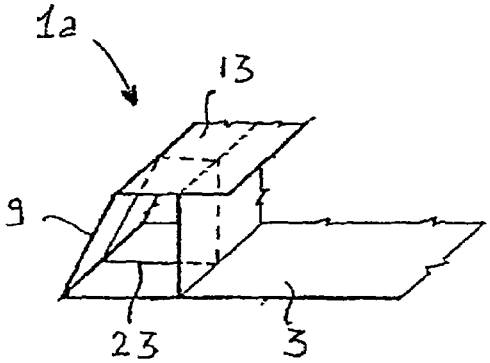
FIG. 9 is a perspective diagrammatic view of a portion of another embodiment of the invention.
Figure 8:
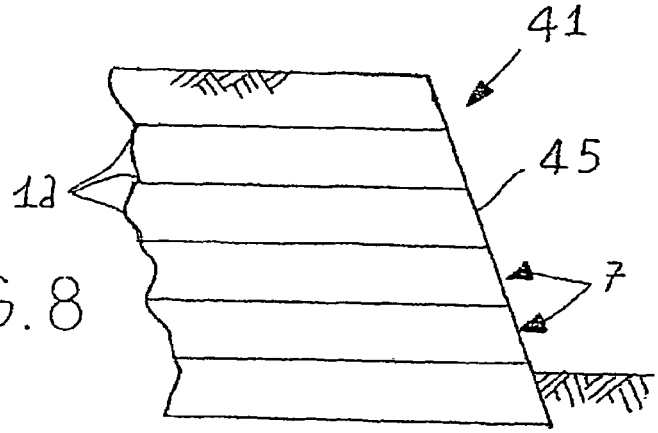

Referring now to FIG. 6, an earthwork 41 comprises a plurality of reinforcing devices 1*a* or, alternatively, a plurality of bifacial reinforcing units 1, superposed on one another with the sides corresponding to the box-shaped structure 5 arranged to form a single vertical wall 43. In a different way, if the box-shaped structures 5 are superposed in a manner in which they are offset relative to one another, a lateral wall 44 with steps is obtained, as illustrated in FIG. 7. In one possible variant illustrated in FIG. 9, the front wall 9 is inclined with respect to the central portion 3 by an angle smaller than ninety degrees, in which case the brackets 23 have a trapezoidal shape and the superposition of the reinforcing devices 1*a* produces a single inclined wall 45 like that illustrated in FIG. 8. A single inclined wall 45 of the same type may also be obtained on one side of the earthwork 41, produced by the superposition of the "C"-shaped structures 7, when bifacial reinforcing units 1 are used, in order to produce a tapered earthwork.

During installation, a bifacial reinforcing unit 1, or a reinforcing device 1*a,* is supported on the soil with the central portion 3 in contact with the ground and the box-shaped structure 5 and the "C"-shaped structure 7 facing upwards. The wall 13, and optionally the flap panel 33, are initially in a raised position shown in FIGS. 1 and 5, while the front wall 9 and the containment wall 15 are supported in a vertical position by the brackets 23, defining the internal chamber of the box-shaped structure 5. The internal chamber is filled by introducing, using a mechanical means, such as a mechanical shovel, filling material, for example stones of a small size, which flows freely inside the chamber, filling it without being obstructed by the brackets 23. The material is then levelled to the height of the top of the box-shaped structure 5 and the covering wall 13 is joined to the containment wall 15 to close the filling material in the box-shaped structure 5. The completion of the reinforced earthwork is effected in accordance with techniques and methods known to persons skilled in the art.

Naturally, the principle of the invention remaining the same, the details and features of construction and the forms of embodiment may be varied widely with respect to those described and illustrated, without thereby departing from the scope of the present invention.

The invention claimed is:

1. A bifacial reinforcing unit for earthworks, comprising a reinforcing device having at least one reinforcing base element from which a first front wall extends, a containment wall extending from the reinforcing base element at a distance from the first front wall in order to delimit at the rear, in an operative configuration in which the first front wall and the containment wall are erected with respect to the reinforcing base element, a first facing region which is to be filled with filling material a bracket coupled, in use, to the first front wall and to the containment wall in order to maintain them in the operative configuration without constituting a substantial obstacle to the filling material of the first facing region, a covering wall which delimits with the base element, the first front wall and the containment wall, said first facing region, the base element, the first front wall and the covering wall being formed from a single netting element, the first front wall and the covering wall comprising bent portions of said single netting element, a second facing region which is to be filled with filling material, the second facing region comprising a second front wall extending from the reinforcing base element spaced from and opposite the first front wall on the other side of the bifacial reinforcing unit, and an upper portion disposed adjacent the second front wall and therewith defining said second facing region.

2. A bifacial reinforcing unit according to claim 1, further comprising brackets located in the first facing region, each coupled, in use, to the first front wall and to the containment wall.

3. A bifacial reinforcing unit according to claim 2, wherein the brackets each comprise a quadrangular configuration with two opposing and spaced-apart sides coupled to the first front wall and to the containment wall, respectively, and another side located near the reinforcing base element.

4. A bifacial reinforcing unit according to claim 2, wherein each bracket is produced using a metal rod.

5. A bifacial reinforcing unit according to claim 1, wherein the first front wall comprises an additional netting structure wherein meshes of the additional netting structure are more closely packed than meshes of the single netting element.

6. A bifacial reinforcing unit according to claim 5, wherein the additional netting structure of the first front wall comprises a wire netting having hexagonal meshes.

7. A bifacial reinforcing unit according to claim 6, wherein the wire netting of the additional netting structure is a first wire netting and the additional netting structure comprises a second wire netting which has meshes different from those of the first wire netting and which is coupled to the first wire netting to constitute overall the additional netting structure having meshes that are more closely packed than the meshes of the single netting element of the reinforcing base element.

8. A bifacial reinforcing unit according to claim 7, wherein the second wire netting is a netting having square meshes.

9. A bifacial reinforcing unit according to claim 1, wherein the containment wall is covered with a geotextile material.

10. A bifacial reinforcing unit according to claim 1, wherein the second front wall is supported in its position by brackets.

11. A bifacial reinforcing unit according to claim 10, wherein, in the operative condition, the second front wall is arranged in an inclined manner with respect to the base element in order to define part of an inclined facing on which vegetation can grow.

12. A bifacial reinforcing unit according to claim 1, wherein said second front wall and said upper portion comprise respective bent portions of said single netting element.

13. A bifacial reinforcing unit according to claim 1, wherein said upper portion is cantilevered from an upper edge portion of said second front wall and defines a free end spaced inwardly from said second front wall and upwardly from said base element.

14. A method for the production of a reinforced earthwork, wherein said method comprising the steps of:

a) providing a bifacial reinforcing unit including a reinforcing device having at least one reinforcing base element from which a first front wall extends, a containment wall extending from the reinforcing base element at a distance from the first front wall in order to delimit at the rear, in an operative configuration in which the first front wall and the containment wall are erected with respect to the reinforcing base element, a first facing region which is to be filled with filling material, a bracket coupled, in use, to the first front wall and to the containment wall in order to maintain them in the operative configuration without constituting a substantial obstacle to the filling material of the first facing region, a covering wall which delimits with the base element, the first front wall and the containment wall said first facing region, the base element, the first front wall and the covering wall being formed from a single netting element, the first front wall and the covering wall comprising bent portions of said single netting element, a second facing region which is to be filled with filling material, the second facing region comprising a second front wall extending from the reinforcing base element disposed on the other side of the bifacial reinforcing unit and opposite to the first front wall, and an upper portion disposed adjacent the second front wall and therewith defining the second facing region, b) laying said bifacial reinforcing unit on a region of leveled earth, c) erecting the first front wall and the containment wall, and holding the first front wall and the containment wall erect and spaced from one another in the operative configuration using the bracket, d) filling the first facing region delimited by the first front wall and the containment wall with a first filling material, having dimensions substantially larger than dimensions of mesh of the first front wall in order to form a portion of a first facing at the location of the first front wall, e) filling and leveling with a second filling material different from the first filling material, a region defined by the reinforcing base element outside the first facing region, to a height substantially equal to a height of the first front wall and the containment wall, and f) repeating stages a) through e), superposing on one another in succession a predetermined number of reinforcing devices until a desired height of the reinforced earthwork is reached.

15. A method according to claim 14, wherein the filling of the first facing region is carried out using mechanical means.

16. A method according to claim 14, wherein the method further comprises, for each repetition, erecting the second front wall so as to define a portion of a second facing at the location of the second front wall.

17. A method according to claim 16, wherein each second front wall of each reinforcing unit is inclined with respect to the respective reinforcing base element by a predetermined angle, the reinforcing base element of each subsequently superposed reinforcing device having dimensions smaller than that of the reinforcing device underneath in order to produce an overall second facing opposite the first facing which is inclined.

18. A method according to claim 16, wherein the second facing is a facing of the type on which vegetation can grow.

19. A bifacial reinforcing unit for earthworks, said unit comprising a substantially flat base element having opposite and horizontally-spaced apart ends, a boxed-shaped structure disposed adjacent one of said ends of said base element and a C-shaped structure disposed adjacent the other of said ends of said base element, said box-shaped structure being defined by a first wall extending upwardly from said one end of said base element, a containment wall extending upwardly from said base element in inwardly-spaced relation from said first wall and between said first wall and said C-shaped structure, and a covering wall joined to an upper edge region of said first wall and spaced upwardly from said base element, said first wall, said containment wall, said covering wall and said base wall together defining a first facing region for containing a filling material, said C-shaped structure being defined by a second wall extending upwardly from the other said end of said base element in horizontally-spaced relation from said first wall, and a top wall joined to an upper edge region of said second wall and spaced upwardly from said base element, said second wall, said top wall and said base element together defining a second facing region for containing a filling material horizontally-spaced from said first facing region.

20. The bifacial reinforcing unit of claim 19, wherein said box-shaped structure and said C-shaped structure each extend along the entire length of the respective said ends of said base element.

21. The bifacial reinforcing unit of claim 19, further comprising a single netting element from which said base wall, said first and second walls, said covering wall and said top wall are formed, said first wall, said covering wall, said second wall and said top wall each being defined by a bent portion of said single netting element.

22. The bifacial reinforcing unit of claim 19, wherein said top wall extends horizontally inwardly from said upper edge region of said second wall towards said first facing region, said top wall being cantilevered from said upper edge region of said second wall and defining a free end spaced inwardly from said second wall.

23. The bifacial reinforcing unit of claim 19, wherein said box-shaped structure and said C-shaped structure are horizontally-spaced from one another and a planar portion of said base element extends therebetween, and said C-shaped structure opens sidewardly into an area located above said planar portion of said base element.

* * * * *